US008749219B2

(12) United States Patent
Kikuchi

(10) Patent No.: US 8,749,219 B2
(45) Date of Patent: Jun. 10, 2014

(54) CURRENT GENERATING CIRCUIT

(75) Inventor: Hiroki Kikuchi, Kyoto (JP)

(73) Assignee: Rohm Co., Ltd. (JP)

( * ) Notice: Subject to any disclaimer, the term of this patent is extended or adjusted under 35 U.S.C. 154(b) by 83 days.

(21) Appl. No.: 13/093,967

(22) Filed: Apr. 26, 2011

(65) Prior Publication Data

US 2012/0119724 A1 May 17, 2012

(30) Foreign Application Priority Data

Apr. 27, 2010 (JP) ..... 2010-102114

(51) Int. Cl.
*G05F 3/26* (2006.01)

(52) U.S. Cl.
USPC ..... 323/315; 323/907

(58) Field of Classification Search
USPC ..... 323/311–316, 907; 327/538–543, 513
See application file for complete search history.

(56) References Cited

U.S. PATENT DOCUMENTS

| | | | | |
|---|---|---|---|---|
| 4,258,310 | A * | 3/1981 | Asakawa et al. | 323/281 |
| 4,792,748 | A * | 12/1988 | Thomas et al. | 323/312 |
| 5,432,433 | A * | 7/1995 | Ikeda | 323/315 |
| 6,799,889 | B2 * | 10/2004 | Pennock | 374/178 |
| 7,106,041 | B1 * | 9/2006 | Cohen | 323/315 |
| 7,486,065 | B2 * | 2/2009 | Lin et al. | 323/313 |
| 7,728,575 | B1 * | 6/2010 | Ozalevli et al. | 323/313 |
| 7,768,248 | B1 * | 8/2010 | Hyde | 323/315 |
| 7,888,987 | B2 * | 2/2011 | Horie | 327/513 |
| 2003/0080720 | A1 * | 5/2003 | Ghozeil et al. | 323/313 |
| 2004/0150381 | A1 * | 8/2004 | Butler | 323/313 |
| 2004/0183515 | A1 * | 9/2004 | Ota et al. | 323/315 |
| 2005/0140350 | A1 * | 6/2005 | Kitagawa et al. | 323/312 |

(Continued)

FOREIGN PATENT DOCUMENTS

| | | | |
|---|---|---|---|
| CN | 101069142 | A | 11/2007 |
| JP | 3-117008 | A | 5/1991 |
| JP | 5-88767 | A | 4/1993 |
| JP | 05-088767 | * | 9/1993 |

OTHER PUBLICATIONS

Paul R. Gray, Paul J. Hurst, Stephen H. Lewis, Robert G. Meyer "Analysis and Design of Analog Integrated Circuits" 4th Edition John Wiley & Sons, Inc. pp. 229-336 (Feb. 15, 2001).

(Continued)

*Primary Examiner* — Gary L Laxton
*Assistant Examiner* — Kyle J Moody
(74) *Attorney, Agent, or Firm* — Cantor Colburn LLP

(57) ABSTRACT

A current generating circuit may include a first current source configured to generate a first current having positive temperature characteristics; a second current source configured to generate a second current; a compensation transistor configured as an NPN bipolar transistor, and arranged such that the second current flows through from its collector and its emitter; and a first current mirror circuit configured to multiply a base current of the compensation transistor by a first coefficient so as to generate a third current. The current generating circuit may be configured to output a fourth current that is proportional to the difference between the first current and the third current.

10 Claims, 6 Drawing Sheets

(56) References Cited

U.S. PATENT DOCUMENTS

| | | | | |
|---|---|---|---|---|
| 2007/0176591 | A1* | 8/2007 | Kimura | 323/315 |
| 2007/0182400 | A1* | 8/2007 | Finney | 323/315 |
| 2007/0273352 | A1* | 11/2007 | Lee et al. | 323/315 |
| 2009/0140792 | A1 | 6/2009 | Horie | |
| 2010/0072972 | A1* | 3/2010 | Yoshikawa | 323/313 |
| 2010/0308788 | A1* | 12/2010 | Sicard | 323/313 |
| 2011/0102071 | A1* | 5/2011 | Zarbadi | 327/539 |
| 2012/0056609 | A1* | 3/2012 | Satoh | 323/313 |
| 2012/0068685 | A1* | 3/2012 | Chang et al. | 323/313 |
| 2012/0139523 | A1* | 6/2012 | Kondo | 323/313 |

OTHER PUBLICATIONS

The First Office Action for Chinese Patent Application No. 201110106199.2, dated Apr. 15, 2014. English translation attached.

Notification of Reasons for Refusal for Japanese Patent Application No. 2010-102114, mailed Feb. 4, 2014. English Translation attached.

* cited by examiner

CURRENT GENERATING CIRCUIT

BACKGROUND OF THE INVENTION

1. Field of the Invention

The present invention relates to a current generating circuit.

2. Description of the Related Art

In semiconductor integrated circuits, a band gap reference voltage circuit (which is also referred to as a "band gap reference (BGR) circuit") is employed in order to generate a constant voltage that is independent of fluctuation in the power supply voltage and fluctuation in the temperature. Patent document 1 discloses an example of the BGR circuit.

The BGR circuit described in Patent document 1 is capable of generating a reference voltage Vref that is stable regardless of fluctuation in the power supply voltage and fluctuation in the temperature. However, such a BGR circuit has a temperature coefficient δVref/δT that is not perfectly zero, which is insufficient depending on the application.

RELATED ART DOCUMENTS

Patent Document

Patent Document 1

Japanese Patent Application Laid Open No. H05-088767

Non-Patent Document 1

PAUL R. GRAY, PAUL J. HURST, STEPHEN H. LEWIS, ROBERT G. MEYER, ANALYSIS AND DESIGN OF ANALOG INTEGRATED CIRCUITS 4th Edition, JOHN WILEY & SONS, INC. pp. 229-336.

The present inventor has investigated the temperature dependence of such a band gap reference circuit, and has come to recognize the following problem.

The temperature dependence of the output voltage of the band gap reference circuit is represented by an upwardly convex (bowl-shaped) curve. The voltage level has a peak at a normal temperature of 25 to 30° C., and drops both when the temperature increases from the normal temperature that corresponds to the peak voltage level and when it drops from the normal temperature.

If such an arrangement is capable of generating a current that is flat in the normal temperature range, and that increases both when the temperature rises from the normal temperature and when it drops from the normal temperature, by using such a current, such an arrangement provides a band gap reference circuit having improved temperature characteristics.

SUMMARY OF THE INVENTION

The present invention has been made in order to solve such a problem. Accordingly, it is an exemplary purpose of an embodiment of the present invention to provide a current generating circuit which is capable of generating a current having a temperature dependence.

An embodiment of the present invention relates to a current generating circuit. The current generating circuit comprises: a first current source configured to generate a first current having positive temperature characteristics; a second current source configured to generate a second current; a compensation transistor configured as an NPN bipolar transistor, and arranged on a path of the second current; and a first current mirror circuit configured to multiply a base current of the compensation transistor by a first coefficient so as to generate a third current. The current generating circuit is configured to output a fourth current that is proportional to the difference between the first current and the third current.

Such an embodiment is capable of generating a current that has a constant level in a range in which the temperature is lower than a predetermined temperature, and that increases according to the temperature in a range in which the temperature is higher than the predetermined temperature.

Also, the first current mirror circuit may be configured to multiply the base current of the compensation transistor by a second coefficient so as to generate a fifth current. Also, instead of the fourth current, the current generating circuit may be configured to output a sixth current that is proportional to the sum of the fourth current and the fifth current.

Such an embodiment is capable of generating a current that exhibits a minimum value at a predetermined temperature, and that increases as the temperature departs from the predetermined temperature.

Also, the first current source may comprise: a first collector resistor, and a first transistor configured as an NPN bipolar transistor arranged such that the base and the emitter thereof are connected together, which are arranged in sequence between a first fixed voltage terminal and a second fixed voltage terminal; a second transistor configured as an NPN bipolar transistor, and arranged such that the base thereof is connected to the base of the first transistor; and a first emitter resistor configured as a polysilicon resistor arranged between the emitter of the second transistor and the second fixed voltage terminal. Also, the first current source may be configured to output, as the first current, a current that flows through the second transistor.

The polysilicon resistor has positive temperature characteristics. Thus, with such a first current source, such an arrangement is capable of generating a first current having positive temperature characteristics.

Also, the second current source may comprise: a second collector resistor, a third transistor configured as an NPN bipolar transistor arranged such that the base and the emitter thereof are connected together, and a diode, which are arranged in sequence between a first fixed voltage terminal and a second fixed voltage terminal; a fourth transistor configured as an NPN bipolar transistor, and arranged such that the base thereof is connected to the base of the third transistor; and a second emitter resistor configured as a polysilicon resistor arranged between the emitter of the fourth transistor and the second fixed voltage terminal. Also, the second current source may be configured to output, as the second current, a current that flows through the fourth transistor.

With such a second current source, the temperature characteristics of the second emitter resistor configured as a polysilicon resistor can be canceled out by means of the diode. Thus, such an arrangement is capable of generating a second current having flat temperature characteristics.

Also, the first current mirror circuit may be configured using a P-channel MOSFET. Also, the first current mirror circuit may be configured as a cascode current mirror circuit.

Another embodiment of the present invention also relates to a current generating circuit. The current generating circuit comprises: a second current source configured to generate a second current; a compensation transistor configured as an NPN bipolar transistor, and arranged on a path of the second current; and a first current mirror circuit configured to multiply a base current of the compensation transistor by a first coefficient so as to generate a third current. With such an arrangement, the current generating circuit is configured to output a current that corresponds to the third current.

Such an embodiment is capable of generating a current that increases as the temperature falls.

Also, the second current source may comprise: a second collector resistor, a third transistor configured as an NPN bipolar transistor, and arranged such that the base and the emitter thereof are connected together, and a diode, which are arranged in sequence between a first fixed voltage terminal and a second fixed voltage terminal; a fourth transistor configured as an NPN bipolar transistor, and arranged such that the base thereof is connected to the base of the third transistor; and a second emitter resistor configured as a polysilicon resistor, and arranged between the emitter of the fourth transistor and the second fixed voltage terminal. Also, the second current source may be configured to output, as the second current, a current that flows through the fourth transistor.

Yet another embodiment of the present invention also relates to a current generating circuit. The current generating circuit comprises: a first collector resistor and a first transistor configured as an NPN bipolar transistor, and arranged such that the base and the emitter thereof are connected together, which are arranged in sequence between a first fixed voltage terminal and a second fixed voltage terminal; a second transistor configured as an NPN bipolar transistor, and arranged such that the base thereof is connected to the base of the first transistor; a first emitter resistor configured as a polysilicon resistor, and arranged between the emitter of the second transistor and the second fixed voltage terminal; a second collector resistor, a third transistor configured as an NPN bipolar transistor, and arranged such that the base and the emitter thereof are connected together, and a diode, which are arranged in sequence between the first fixed voltage terminal and the second fixed voltage terminal; a fourth transistor configured as an NPN bipolar transistor, and arranged such that the base thereof is connected to the base of the third transistor; a second emitter resistor configured as a polysilicon resistor, and arranged between the emitter of the fourth transistor and the second fixed voltage terminal; a compensation transistor configured as an NPN bipolar transistor, and arranged between the collector of the fourth transistor and the first fixed voltage terminal; a first current mirror circuit arranged such that an input terminal thereof is connected to the base of the compensation transistor, and a first output terminal thereof is connected to the collector of the second transistor; and a second current mirror circuit arranged such that an input terminal thereof is connected to the collector of the second transistor. The current generating circuit is configured to output the output current of the second current mirror circuit.

Such an embodiment is capable of generating a current that has a constant level in a range in which the temperature is lower than a predetermined temperature, and that increases according to the temperature in a range in which the temperature is higher than the predetermined temperature.

Also, the first current mirror circuit may be configured to output, via a second output terminal, a current obtained by multiplying the base current of the compensation transistor by a second coefficient. Also, the second output terminal of the first current mirror circuit may be connected to an output terminal of the second current mirror circuit. Also, the current generating circuit may be configured to output the sum total of the current output via the second output terminal of the first current mirror circuit and the current output via the output terminal of the second current mirror circuit.

Such an embodiment is capable of generating a current that exhibits a minimum value at a predetermined temperature, and that increases as the temperature departs from the predetermined temperature.

Yet another embodiment of the present invention also relates to a current generating circuit. The current generating circuit comprises: a second collector resistor, a third transistor configured as an NPN bipolar transistor, and arranged such that the base and the emitter thereof are connected together, and a diode, which are arranged in sequence between a first fixed voltage terminal and a second fixed voltage terminal; a fourth transistor configured as an NPN bipolar transistor, and arranged such that the base thereof is connected to the base of the third transistor; a second emitter resistor configured as a polysilicon resistor, and arranged between the emitter of the fourth transistor and the second fixed voltage terminal; a compensation transistor configured as an NPN bipolar transistor, and arranged between the collector of the fourth transistor and the first fixed voltage terminal; and a first current mirror circuit arranged such that an input terminal thereof is connected to the base of the compensation transistor. The current generating circuit is configured to output an output current of the first current mirror circuit.

Such an embodiment is capable of generating a current that increases as the temperature falls.

Yet another embodiment of the present invention relates to a reference voltage circuit. The reference voltage circuit comprises: a band gap reference circuit; and a current generating circuit according to any one of the aforementioned embodiments, connected to one of the nodes included in the band gap reference circuit.

Such an embodiment provides the improved temperature characteristics of the output voltage of the band gap reference circuit.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A is indirectly connected to the member B via another member that does not substantially affect the electric connection therebetween, or that does not damage the functions or effects of the connection therebetween, in addition to a state in which the member A is physically and directly connected to the member B.

Similarly, the state represented by the phrase "the member C is provided between the member A and the member B" includes a state in which the member A is indirectly connected to the member C, or the member B is indirectly connected to the member C via another member that does not substantially affect the electric connection therebetween, or that does not damage the functions or effects of the connection therebetween, in addition to a state in which the member A is directly connected to the member C, or the member B is directly connected to the member C.

Figure 1:
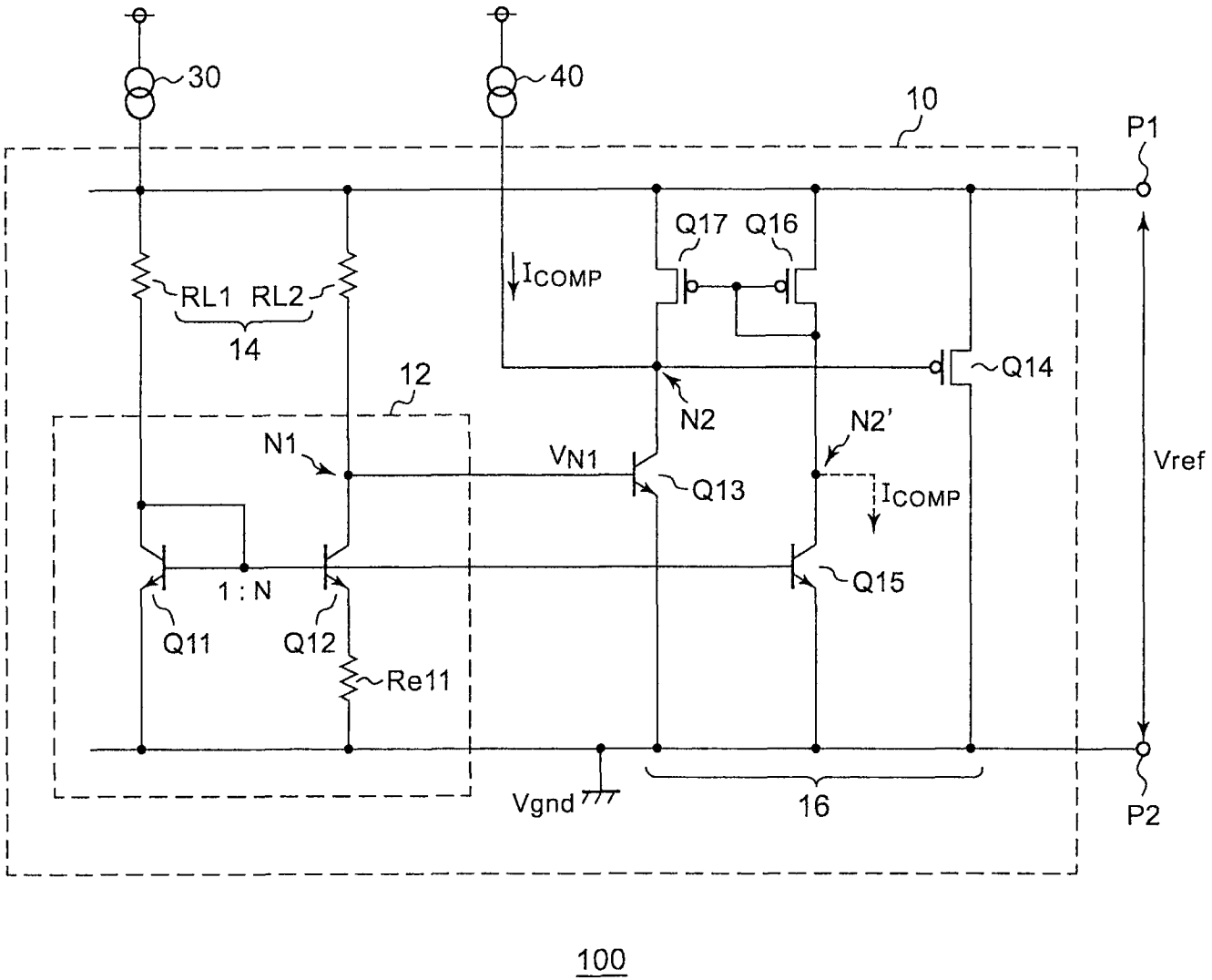
FIG. 1 is a circuit diagram which shows a configuration of a reference voltage circuit according to an embodiment.

FIG. 1 is a circuit diagram which shows a configuration of a reference voltage circuit 100 according to an embodiment. The reference voltage circuit 100 includes a band gap reference circuit 10, a current source 30, and a current generating circuit 40.

The current source 30 and the band gap reference circuit 10 are stacked in sequence between a first fixed voltage terminal (power supply terminal) to which the power supply voltage Vcc is to be applied and a second fixed voltage terminal (ground terminal) to which the ground voltage Vgnd is to be applied. The band gap reference circuit 10 generates a reference voltage Vref between both its terminals.

Description will be made regarding a specific configuration of the band gap reference circuit 10.

The band gap reference circuit 10 includes a first terminal P1, a second terminal P2, a Widlar current mirror circuit 12, a load circuit 14, and an output circuit 16. The band gap reference circuit 10 generates the reference voltage Vref between the first terminal P1 and the second terminal P2.

The Widlar current mirror circuit 12 is arranged on the second terminal P2 side. The Widlar current mirror circuit 12 includes a first transistor Q11 and a second transistor Q12, each configured as an NPN bipolar transistor, and an emitter resistor Re11. The size ratio between the first transistor Q11 and the second transistor Q12 is 1:N.

The load circuit 14 is arranged between the Widlar current mirror circuit 12 and the second terminal P2. Specifically, the load circuit 14 includes a first load resistor RL1 arranged on a path of the first transistor Q11 and a second load resistor RL2 arranged on a path of the second transistor Q12. It should be noted that an active load (current mirror circuit) may be employed as the load circuit 14.

The output circuit 16 generates the reference voltage Vref between the first terminal P1 and the second terminal P2 according to the electric potential $V_{N1}$ at a connection node N1 that connects the load circuit 14 and the second transistor Q12.

The output circuit 16 includes a third transistor Q13 through a seventh transistor Q17. The voltage $V_{N1}$ that occurs at the connection node N1 is input to the base of the third transistor Q13 (first amplifier transistor). The transistors Q15 through Q17 function as a bias circuit configured to supply, to the third transistor Q13, a current that is proportional to the current that flows through the transistors Q11 and Q12. The fourth transistor (first output transistor) Q14 is arranged to receive, via the gate thereof, the collector voltage of the third transistor Q13, such that it functions as a source follower circuit. The fourth transistor Q14 may be configured as a PNP bipolar transistor.

The transistors Q14 through Q17 can be regarded as being equivalent to a buffer circuit configured to output a voltage (current) that corresponds to the state of the third transistor Q13. It should be noted that the configuration of the output circuit 16 is not restricted to such a configuration shown in FIG. 1.

Directing attention to the band gap reference circuit 10, the current $I_{Q11}$ that flows through the first transistor Q11 is represented by the following Expression (1).

$$I_{Q11}=V_{TN}\cdot In(N)/Re11 \tag{1}$$

Here, $V_{TN}$ represents the thermal voltage of the NPN bipolar transistor Q11. Accordingly, the reference voltage Vref generated by the band gap reference circuit 10 is represented by the following Expression (2).

$$Vref = V_F + I_{Q11} \times RL1 = V_F + V_{TN} \cdot \mathrm{In}(N)/Re11 \times RL1 \tag{2}$$

Here, $V_F$ represents the base-emitter forward voltage of the bipolar transistor Q11.

The reference voltage Vref represented by the aforementioned Expression (2) has a temperature dependence represented by an upwardly convex curve. Depending on the application, the temperature dependence thus obtained is insufficient. In some situations, there is a need to provide further improved, i.e., more flat, temperature characteristics.

The current generating circuit 40 generates a compensation current $I_{COMP}$ having a temperature dependence in order to improve the temperature dependence of the band gap reference circuit 10. The current generating circuit 40 supplies the compensation current $I_{COMP}$ thus generated to a node N2 included in the band gap reference circuit 10.

Figure 2:
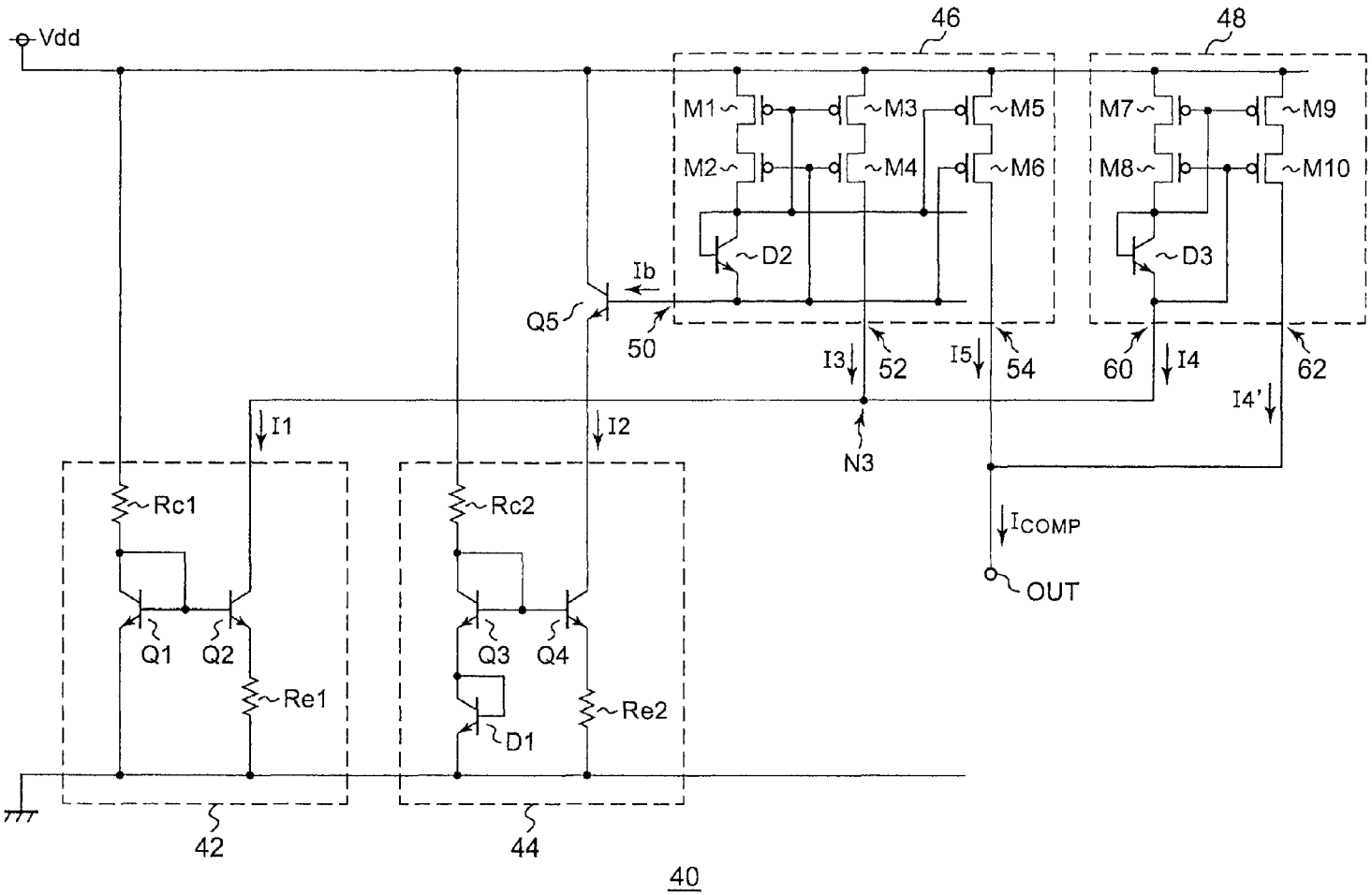
FIG. 2 is a circuit diagram which shows a configuration of a current generating circuit according to an embodiment.

Description will be made below regarding a configuration of the current generating circuit 40 suitably employed for this kind of usage. FIG. 2 is a circuit diagram which shows the configuration of the current generating circuit 40 according to an embodiment.

The current generating circuit 40 includes a first current source 42, a second current source 44, a first current mirror circuit 46, a second current mirror circuit 48, and a compensation transistor Q5.

The first current source 42 generates a first current I1 having positive temperature characteristics. The first current source 42 includes a first collector resistor Rc1, a first transistor Q1, a second transistor Q2, and a first emitter resistor Re1.

The first collector resistor Rc1 and the first transistor Q1 are arranged in sequence between a first fixed voltage terminal (power supply terminal) to which the power supply voltage Vdd is applied and a second fixed voltage terminal (ground terminal) to which the ground voltage Vgnd is applied. The first transistor Q1 is configured as an NPN bipolar transistor, and is arranged such that the base and the collector thereof are connected together.

The second transistor Q2 is configured as an NPN bipolar transistor, which is the same conduction type as that of the first transistor Q1. The second transistor Q2 is arranged such that the base thereof is connected to the base of the first transistor Q1. The first emitter resistor Re1 is configured as a polysilicon resistor having positive temperature characteristics, and is arranged between the emitter of the second transistor Q2 and the ground terminal. The first transistor Q1, the second transistor Q2, and the first emitter resistor Re1 form a so-called Widlar current mirror circuit.

The first current source 42 outputs, as the first current I1, the collector current that flows through the second transistor Q2. By configuring the first emitter resistor Re1 as a polysilicon resistor, such an arrangement is capable of generating a first current I1 having positive temperature characteristics that reflects the temperature characteristics of the first emitter resistor Re1, thereby generating the first current I1 having positive temperature characteristics.

The second current source 44 generates a second current I2. The second current I2 preferably has flat temperature characteristics. The second current source 44 includes a second collector resistor Rc2, a third transistor Q3, a fourth transistor Q4, a second emitter resistor Re2, and a diode D1.

The second collector resistor Rc2, the third transistor Q3, and the diode D1 are arranged in sequence between the power supply terminal and the ground terminal. The third transistor Q3 is configured as an NPN bipolar transistor, and is arranged such that the base and the collector thereof are connected together. The diode D1 is configured as an NPN bipolar transistor arranged such that the base and the collector thereof are connected together. Also, a P-N conjunction diode may be employed as such a diode D1.

The fourth transistor Q4 is configured as an NPN bipolar transistor, which is the same conduction type as that of the third transistor Q3. The fourth transistor Q4 is arranged such that the base thereof is connected to the base of the third transistor Q3. The second emitter resistor Re2 is configured as a polysilicon resistor, and is arranged between the emitter of the fourth transistor Q4 and the ground terminal.

The second current source 44 outputs, as the second current I2, the collector current that flows through the fourth transistor Q4. The second emitter resistor Re2 has a resistance having positive temperature characteristics, and the forward voltage of the diode D1 also has positive temperature characteristics. The temperature characteristics of the resistance of the second emitter resistor Re2 and of the forward voltage of the diode D2 thus cancel each other out, whereby such an arrangement is capable of generating a second current I2 having flat temperature characteristics.

The compensation transistor Q5 is configured as an NPN bipolar transistor, and is arranged on a path of the second current I2. With the current amplification ratio of the compensation transistor Q5 as β, the base current Ib of the compensation transistor Q5 is represented by Ib=I2/β. The current amplification ratio β has positive temperature characteristics. Accordingly, assuming that the second current I2 has flat temperature characteristics, the base current Ib has negative temperature characteristics.

The first current mirror circuit 46 includes an input terminal 50, a first output terminal 52, and a second output terminal 54. The input terminal 50 of the first current mirror circuit 46 is connected to the base of the compensation transistor Q5. The first current mirror circuit 46 multiplies the base current Ib of the compensation transistor Q5 by a first coefficient K1 so as to generate a third current I3 (=Ib×K1), and outputs the third current I3 thus generated via the first output terminal 52. FIG. 2 shows an arrangement in which K1=1. That is to say, like the base current Ib, the third current I3 has negative temperature characteristics.

The first output terminal 52 of the first current mirror circuit 46 is connected to the output terminal of the first current source 42, i.e., the collector of the second transistor Q2.

The first current mirror circuit 46 multiplies the base current Ib of the compensation transistor Q5 by a second coefficient (K2) so as to generate a fifth current I5 (=Ib×K2), and outputs the fifth current I5 thus generated via the second output terminal 54. The second output terminal 54 of the first current mirror circuit 46 is connected to the output terminal OUT of the current generating circuit 40.

The first current mirror circuit 46 is configured as a cascode current mirror circuit including a diode D2, and transistors M1 through M6 each configured as a P-channel MOSFET. Such a first current mirror circuit 46 is capable of providing stable mirror ratios K1 and K2 over a wide current range.

It should be noted that, as the first current mirror circuit 46, such an arrangement may employ a current mirror circuit having a simple configuration including two transistors arranged such that their gates are connected together and their sources are connected together.

An input terminal 60 of the second current mirror circuit 48 is connected to the output terminal of the first current source 42, i.e., the collector of the second transistor Q2. At the node N3, the law of conservation of electric current is satisfied.

$$I1=I3+I4.$$

Here, I4 represents an input current that flows to the input terminal 60 of the second current mirror circuit 48. That is to say, the input current I4 is represented by I4=I1−I3, which is the current difference between the first current I1 and the third current I3.

The second current mirror circuit 48 generates a current I4'=I4×K3, which is obtained by multiplying the input current I4 thereof by a constant coefficient, and outputs the resulting current via an output terminal 62 thereof. The output terminal 62 of the second current mirror circuit 48 is connected to the output terminal OUT of the current generating circuit 40. Here, K3 represents the mirror ratio of the second current mirror circuit 48. FIG. 2 shows an arrangement in which K3=1, and accordingly, the relation I4'=I4 holds true.

The second current mirror circuit 48 is configured as a cascode current mirror circuit, in the same way as the first current mirror circuit 46. The second current mirror circuit 48 includes transistors M7 through M10 each configured as a P-channel MOSFET, and a diode D3.

The current $I_{COMP}$ output from the output terminal OUT of the current generating circuit 40 is the sum total of the fourth current I4' and the fifth current I5, i.e., is represented by I4'+I5.

Figure 3:
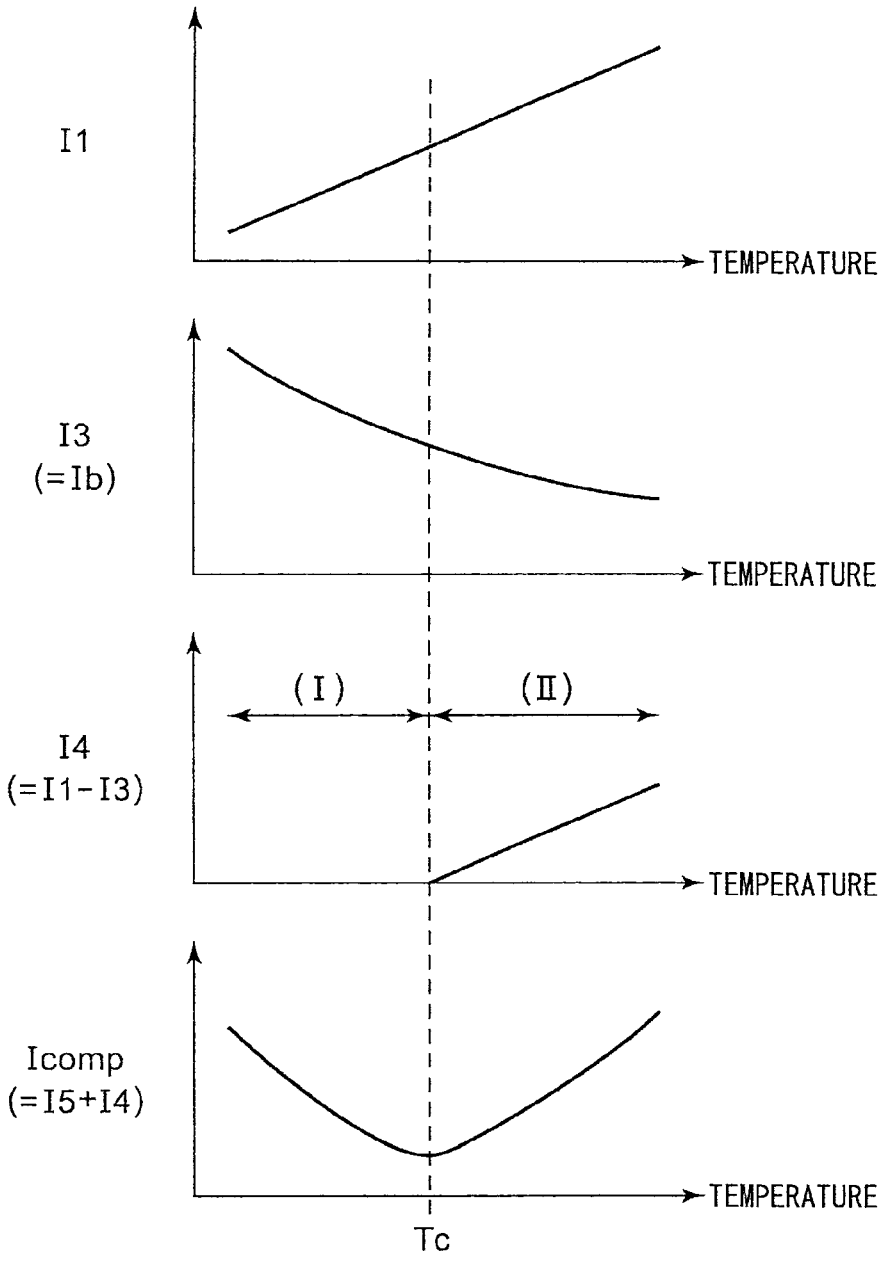
FIG. 3 shows graphs showing each of the currents that flow in the current generating circuit shown in FIG. 2.

The above is the configuration of the current generating circuit 40. Next, description will be made regarding the operation thereof. FIG. 3 shows graphs showing each of the currents that flow in the current generating circuit 40 shown in FIG. 2.

The first current I1 has positive temperature characteristics. The third current I3 and the base current Ib of the compensation transistor Q5 each have negative temperature characteristics. The fourth current I4 is configured to be the current difference between the first current I1 and the third current I3. With such an arrangement, the fourth current cannot flow in the reverse direction. Accordingly, in a temperature range (I) in which I3>I1, the fourth current I4 becomes zero. In a temperature range (II) in which I3<I1, the fourth current I4 has a positive temperature dependence.

The compensation current $I_{COMP}$ is represented by $I_{COMP}$=Ib×K2+I4.

As described above, with the current generating circuit 40 according to the embodiment, such an arrangement is capable of generating a compensation current $I_{COMP}$ that exhibits a minimum value at a predetermined center temperature Tc, and that increases both when the temperature becomes lower and when the temperature becomes higher.

Figure 4:
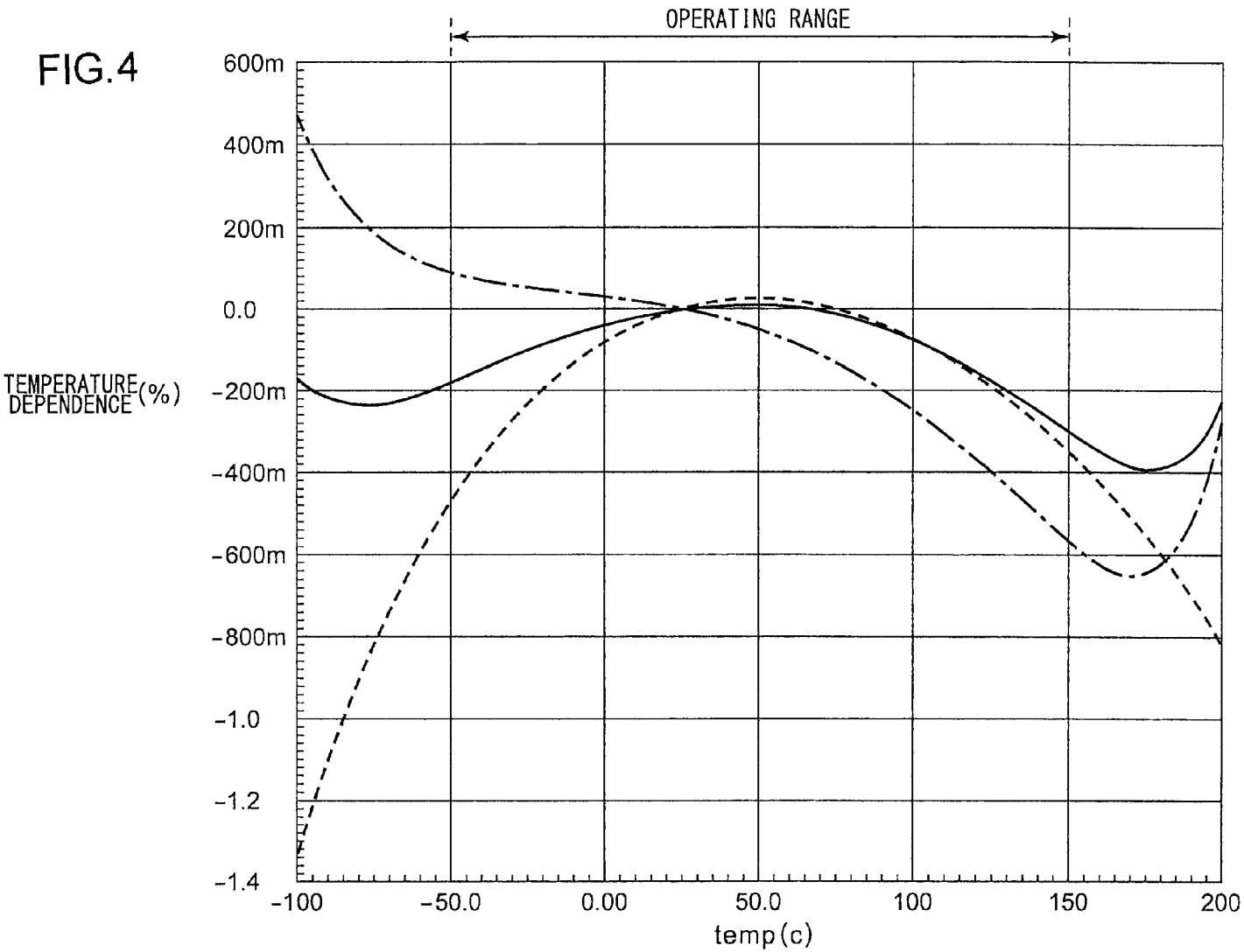
FIG. 4 is a graph showing the temperature dependence of the output voltage Vref of the reference voltage circuit shown in FIG. 1.

By supplying the compensation current $I_{COMP}$ having such a temperature dependence to the node N2 included in the band gap reference circuit 10 shown in FIG. 1, such an arrangement is capable of improving the temperature dependence of the reference voltage Vref generated by the band gap reference circuit 10. FIG. 4 is a graph showing the temperature dependence of the output voltage Vref of the reference voltage circuit 100 shown in FIG. 1. The solid line represents the temperature dependence in a case in which the compensation current $I_{COMP}$ generated by the current generating circuit 40 shown in FIG. 2 is injected into the node N2. The broken line represents the temperature dependence in a case in which the compensation current $I_{COMP}$ is not injected. The vertical axis represents the relative error (%), with the error at a normal temperature of 25° C. as the base value.

Typical electronic devices provide a guaranteed operating temperature range (usage temperature range), e.g., −50 to 150° C. In a case in which the compensation current $I_{COMP}$ is not injected, such an arrangement has a temperature dependence represented by an upwardly convex curve as represented by the broken line. In contrast, by generating a compensation current $I_{COMP}$ having a temperature dependence represented by an upwardly concave (downwardly convex) curve, and by injecting the compensation current $I_{COMP}$ thus generated into the band gap reference circuit 10, such an arrangement is capable of greatly improving the temperature dependence over the operating range.

It should be noted that, the center temperature Tc shown in FIG. 3 should be designed so as to provide the minimum error. The adjustment of the center temperature Tc can be optimized by adjusting the coefficients K1 through K3 of the current mirror circuits shown in FIG. 2.

Description has been made regarding the prevent invention with reference to the embodiments. The above-described embodiments have been described for exemplary purposes only, and are by no means intended to be interpreted restrictively. Rather, various modifications may be made by making various combinations of the aforementioned components or processes. Description will be made below regarding such modifications.

First Modification

Figure 5:
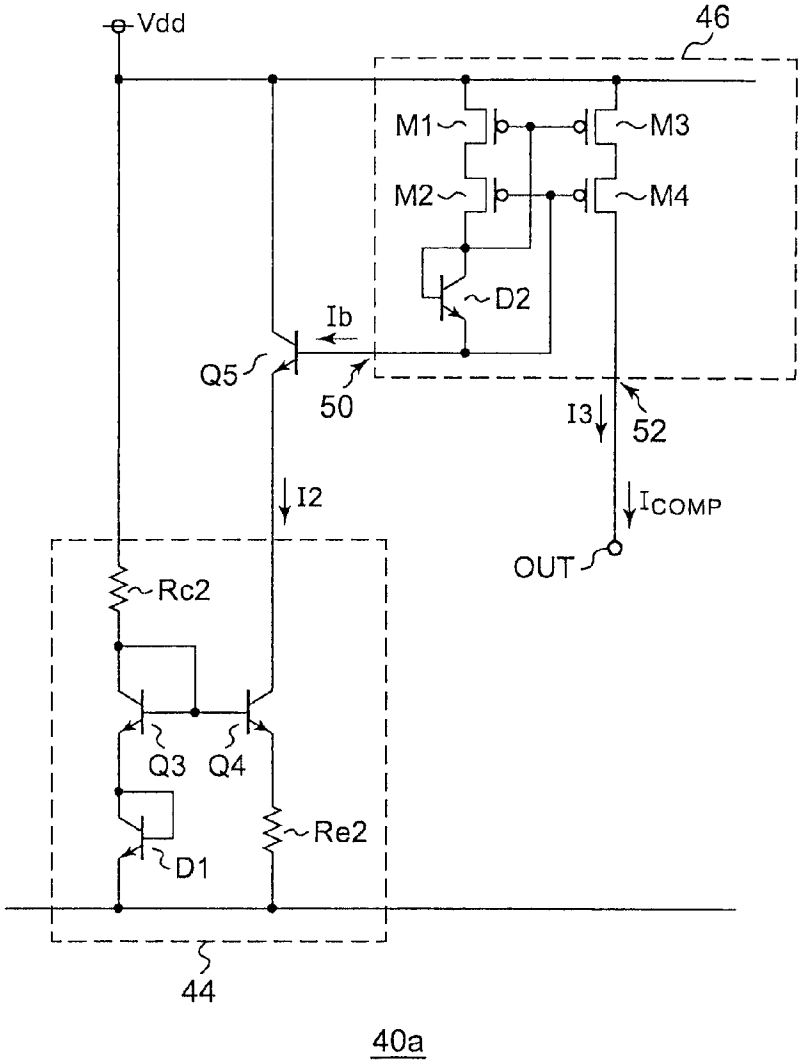
FIG. 5 is a circuit diagram which shows a configuration of a current generating circuit according to a first modification.

The compensation current $I_{COMP}$ generated by the current generating circuit 40 shown in FIG. 2 is capable of improving the temperature dependence of the current generating circuit 40 both in the low-temperature range and in the high-temperature range. However, some applications of the reference voltage circuit 100 require improved temperature dependence only in the low-temperature range. A first modification relates to a current generating circuit 40*a* which can be used in such an application. FIG. 5 is a circuit diagram which shows a configuration of the current generating circuit 40*a* according to the first modification.

The current generating circuit 40*a* shown in FIG. 5 includes a second current source 44, a compensation transistor Q5, and a first current mirror circuit 46. The configuration of each component has been described above, and accordingly, description thereof will be omitted. The current generating circuit 40*a* outputs, as the compensation current $I_{COMP}$, the third current I3 that corresponds to the base current Ib of the compensation transistor Q5.

Such a current generating circuit 40*a* is capable of generating a compensation current $I_{COMP}$ having negative temperature characteristics as shown in FIG. 3.

The line of dashes and dots shown in FIG. 4 represents the temperature dependence in a case in which the compensation current $I_{COMP}$ generated by the current generating circuit 40*a* shown in FIG. 5 is injected. By supplying the compensation current $I_{COMP}$ having negative temperature characteristics to the node N2 included in the band gap reference circuit 10 shown in FIG. 1, over the low-temperature range, such an arrangement is capable of improving the temperature dependence of the reference voltage Vref generated by the band gap reference circuit 10.

Second Modification

Figure 6:
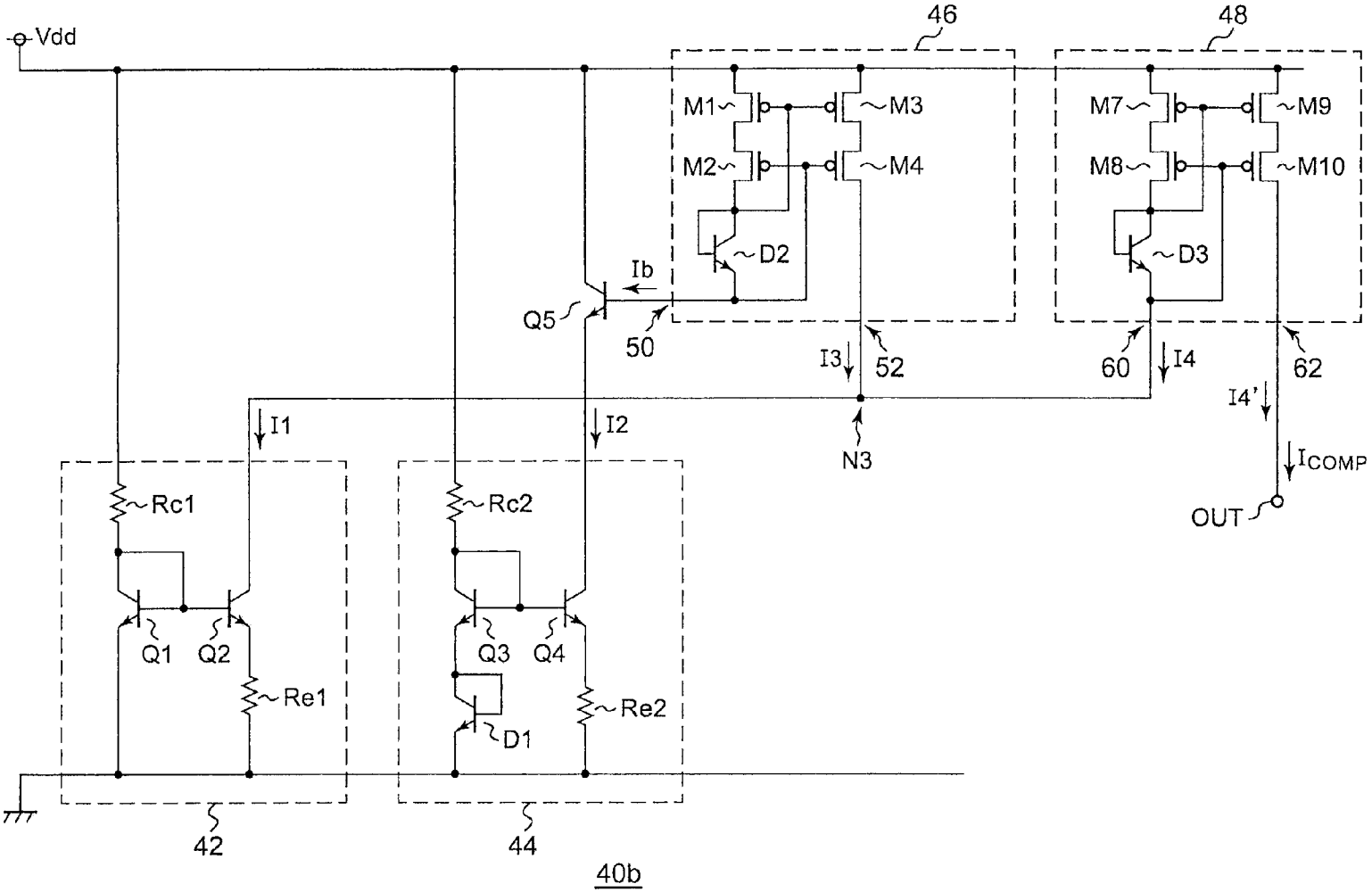
FIG. 6 is a circuit diagram which shows a configuration of a current generating circuit according to a second modification.

Some applications of the reference voltage circuit 100 require improved temperature dependence only in the high-temperature range. For example, an LED driver generates a driving current for driving an LED based on a reference voltage Vref. However, in many cases, such an arrangement has a problem in that heat generation leads to the temperature of the IC becoming high. Accordingly, there is a demand for improving the temperature dependence of the reference voltage Vref, particularly in such a high-temperature range. A second modification relates to a current generating circuit 40*b* which can be used in such an application. FIG. 6 is a circuit diagram which shows a configuration of the current generating circuit 40*b* according to the second modification.

The current generating circuit 40*b* shown in FIG. 6 includes a first current source 42, a second current source 44, a first current mirror circuit 46, and a second current mirror circuit 48. The current generating circuit 40*b* outputs, as the compensation current $I_{COMP}$, an output current I4' of the second current mirror circuit 48, i.e., a current that is proportional to the difference between the first current I1 and the third current I3.

Such a current generating circuit 40*b* is capable of generating a compensation current $I_{COMP}$ that has flat temperature characteristics in a range (I) in which the temperature is lower than a predetermined temperature, and that has positive temperature characteristics in a temperature range (II) in which the temperature is higher than the predetermined temperature, like the fourth current I4 shown in FIG. 3.

By injecting such a compensation current $I_{COMP}$ into the reference voltage circuit 100 shown in FIG. 1, such an arrangement provides the improved temperature dependence in the high-temperature range.

The node into which the compensation current $I_{COMP}$ generated by each of the current generating circuits 40 described above is to be injected is not restricted to such a node N2 shown in FIG. 1. For example, the current generating circuit 40 may be configured to draw the compensation current $I_{COMP}$ (i.e., may be configured as a current sink type circuit), and the output terminal OUT thereof may be connected to a node N2' that is the collector of the fifth transistor Q15. Such an arrangement provides the same compensation effects.

The configuration of the band gap reference circuit 10 is not restricted to such a configuration shown in FIG. 1. Also, other configurations may be employed. The compensation current $I_{COMP}$ generated by the current generating circuit 40 should be connected to an appropriate node based upon the circuit configuration of the band gap reference circuit 10, which can be suitably designed by those skilled in this art.

Furthermore, the usage of the current generating circuit 40 is not restricted to improving the temperature characteristics of the band gap reference circuit 10. Also, the current $I_{COMP}$ having the aforementioned temperature dependence can be used in various applications.

While the preferred embodiments of the present invention have been described using specific terms, such description is for illustrative purposes only, and it is to be understood that changes and variations may be made without departing from the spirit or scope of the appended claims.

What is claimed is:

1. A current generating circuit comprising:

a first current source configured to generate a first current (I1) having positive temperature characteristics;

a second current source configured to generate a second current (I2) having flat temperature characteristics;

a compensation transistor configured as an NPN bipolar transistor, and arranged such that the second current (I2) flows through from a collector of the compensation transistor and an emitter of the compensation transistor;

a first current mirror circuit configured to multiply a base current of the compensation transistor by a first coefficient so as to generate a third current (I3) having negative temperature characteristics; and a current path through which a fourth current (I4) flows, wherein an output terminal of the first current source, an output terminal of the first current minor circuit and one end of the current path are connected at one node, and I1=I3+I4 is established, and the fourth current (I4) is the difference between the first current (I1) and the third current (I3), and wherein the current generating circuit is configured to output a current based on the fourth current (I4).

2. The current generating circuit according to claim 1, wherein the first current mirror circuit is configured to multiply the base current of the compensation transistor by a second coefficient so as to generate a fifth current, and wherein the current generating circuit is configured to output a sixth current that is proportional to the sum of the fourth current and the fifth current.

3. The current generating circuit according to claim 1, wherein the first current source comprises:

a first collector resistor, and a first transistor configured as an NPN bipolar transistor arranged such that the base and the emitter thereof are connected together, which are arranged in sequence between a first fixed voltage terminal and a second fixed voltage terminal;

a second transistor configured as an NPN bipolar transistor, and arranged such that the base thereof is connected to the base of the first transistor; and a first emitter resistor configured as a polysilicon resistor arranged between the emitter of the second transistor and the second fixed voltage terminal, and wherein the first current source is configured to output, as the first current, a current that flows through the second transistor.

4. The current generating circuit according to claim 1, wherein the second current source comprises:

a second collector resistor, a third transistor configured as an NPN bipolar transistor arranged such that the base and the emitter thereof are connected together, and a diode, which are arranged in sequence between a first fixed voltage terminal and a second fixed voltage terminal;

a fourth transistor configured as an NPN bipolar transistor, and arranged such that the base thereof is connected to the base of the third transistor; and a second emitter resistor configured as a polysilicon resistor arranged between the emitter of the fourth transistor and the second fixed voltage terminal, and wherein the second current source is configured to output, as the second current, a current that flows through the fourth transistor.

5. The current generating circuit according to claim 1, wherein the first current mirror circuit is configured using a P-channel MOSFET.

6. The current generating circuit according to claim 1, wherein the first current mirror circuit is configured as a cascode current mirror circuit.

7. A reference voltage circuit comprising:

a band gap reference circuit; and the current generating circuit according to claim 1, connected to a node included in the band gap reference circuit.

8. A current generating circuit comprising:

a first collector resistor and a first transistor configured as an NPN bipolar transistor, and arranged such that a base and an emitter thereof are connected together, which are arranged in sequence between a first fixed voltage terminal and a second fixed voltage terminal;

a second transistor configured as an NPN bipolar transistor, and arranged such that a base thereof is connected to the base of the first transistor;

a first emitter resistor configured as a polysilicon resistor, and arranged between an emitter of the second transistor and the second fixed voltage terminal;

a second collector resistor, a third transistor configured as an NPN bipolar transistor, and arranged such that a base and an emitter thereof are connected together, and a diode, which are arranged in sequence between the first fixed voltage terminal and the second fixed voltage terminal;

a fourth transistor configured as an NPN bipolar transistor, and arranged such that a base thereof is connected to the base of the third transistor;

a second emitter resistor configured as a polysilicon resistor, and arranged between an emitter of the fourth transistor and the second fixed voltage terminal;

a compensation transistor configured as an NPN bipolar transistor, and arranged between a collector of the fourth transistor and the first fixed voltage terminal;

a first current mirror circuit arranged such that an input terminal thereof is connected to a base of the compensation transistor, and a first output terminal thereof is connected to a collector of the second transistor; and a second current mirror circuit arranged such that an input terminal thereof is connected to the collector of the second transistor, wherein the current generating circuit is configured to output an output current of the second current mirror circuit.

9. The current generating circuit according to claim 8, wherein the first current mirror circuit is configured to output, via a second output terminal, a current obtained by multiplying a base current of the compensation transistor by a second coefficient, and wherein the second output terminal of the first current mirror circuit is connected to an output terminal of the second current minor circuit, and wherein the current generating circuit is configured to output a sum total of the current output via the second output terminal of the first current mirror circuit and the current output via the output terminal of the second current minor circuit.

10. A reference voltage circuit comprising:

a band gap reference circuit; and the current generating circuit according to claim 8, connected to a node included in the band gap reference circuit.

* * * * *